US006173862B1

(12) United States Patent
Buca et al.

(10) Patent No.: US 6,173,862 B1
(45) Date of Patent: Jan. 16, 2001

(54) BEVERAGE DISPENSE HEAD

(75) Inventors: Peter V. Buca, Parma Heights; Rex J. Harvey, Mentor; Christopher H. Hunter, Shaker Heights, all of OH (US)

(73) Assignee: Parker-Hannifin Corporation, Cleveland, OH (US)

( * ) Notice: Under 35 U.S.C. 154(b), the term of this patent shall be extended for 0 days.

(21) Appl. No.: 09/268,278

(22) Filed: Mar. 15, 1999

Related U.S. Application Data

(60) Provisional application No. 60/084,234, filed on May 5, 1998, now abandoned.

(51) Int. Cl.[7] ..... B67D 5/56

(52) U.S. Cl. ..... 222/1; 222/129.1; 222/566; 239/425; 239/433

(58) Field of Search ..... 222/129.1, 129.2, 222/129.3, 129.4, 145.3, 566, 1; 239/425, 433

(56) References Cited

U.S. PATENT DOCUMENTS

| | | | | |
|---|---|---|---|---|
| Re. 35,780 | | 5/1998 | Hassell et al. | 222/129.2 |
| 2,836,234 | | 5/1958 | Sage | 239/424 |
| 3,404,838 | | 10/1968 | Hawk, Sr. | 239/79 |
| 3,415,426 | | 12/1968 | Kleveland | 222/402.11 |
| 3,782,884 | | 1/1974 | Shumaker | 431/186 |
| 3,799,438 | | 3/1974 | Shockley | 239/8 |
| 3,807,632 | | 4/1974 | Johnson, Jr. | 239/104 |
| 3,876,150 | | 4/1975 | Dwyer, Jr. et al. | 239/424 |
| 3,896,996 | | 7/1975 | Roest et al. | 239/424 |
| 4,022,379 | | 5/1977 | Ladisch | 239/8 |
| 4,173,296 | | 11/1979 | Marshall | 222/129.1 |
| 4,218,014 | | 8/1980 | Tracy | 239/106 |
| 4,261,511 | | 4/1981 | Erb et al. | 239/8 |
| 4,765,513 | | 8/1988 | McMillin et al. | 222/129.1 |
| 4,796,813 | * | 1/1989 | Marshall | 239/425 |
| 4,878,829 | | 11/1989 | Anderson | 431/8 |
| 4,936,488 | | 6/1990 | Austin | 222/129.1 |
| 5,000,357 | | 3/1991 | Shannon et al. | 222/129.1 |
| 5,033,651 | * | 7/1991 | Whigham et al. | 222/129.1 |
| 5,186,363 | * | 2/1993 | Haynes | 222/129.1 |
| 5,203,474 | * | 4/1993 | Haynes | 222/129.1 |
| 5,256,301 | | 10/1993 | Hassell et al. | 222/129.2 |
| 5,435,884 | | 7/1995 | Simmons et al. | 216/100 |

FOREIGN PATENT DOCUMENTS

| | | |
|---|---|---|
| 423352 | 1/1926 | (DE) . |
| 0 222 596 A2 | 5/1997 | (EP) . |
| 962757 | 1/1964 | (GB) . |
| 1 418 695 | 12/1975 | (GB) . |
| 2 244 977 | 12/1991 | (GB) . |
| 2 256 636 | 12/1992 | (GB) . |
| 2 269 761 | 12/1995 | (GB) . |
| WO 93/24406 | 12/1993 | (WO) . |

OTHER PUBLICATIONS

Publication entitled 6$^{th}$ Edition College Chemistry with Qualitative Analysis by William H. Nebergall, Henry F Holtzclaw, Jr. and William R. Robison; copyrighted 1980 by D.C. Heath and Company.

* cited by examiner

*Primary Examiner*—Joseph A. Kaufman
(74) *Attorney, Agent, or Firm*—Christopher H. Hunter

(57) ABSTRACT

A multi-flavor post-mix dispense head includes a nozzle having a plurality of concentrate inlet ports for directing concentrate(s) to a plurality of outlet ports; and a diluent inlet port for directing a diluent to an annular outlet port, surrounding the concentrate outlet ports. The annular diluent outlet port has a configuration which forms a cylindrical outlet flow of diluent surrounding a liquid stream of concentrate from any of the concentrate outlet ports. The cylindrical outlet flow of diluent combines under surface tension into a single stream to form a freely-supported cup downstream from the nozzle. The concentrates are respectively introduced through the concentrate outlet ports internally of the cup in a stream or spray to be mixed together with the diluent and then flow downstream together in a homogenous mixture.

34 Claims, 7 Drawing Sheets

BEVERAGE DISPENSE HEAD

RELATED CASES

The present application claims priority to U.S. Provisional Application Ser. No. 60/084,234; filed May 5, 1998 now abandoned.

FIELD OF THE INVENTION

The present invention relates generally to dispense heads for mixing and dispensing fluid, and more particularly to a post-mix beverage dispense head which mixes a diluent with at least one concentrate.

BACKGROUND OF THE INVENTION

Various structures for beverage dispensing heads are well-known for dispensing single-flavor or multiple-flavor drinks in a post-mix operation, that is, where the constituent components of the beverage are combined outside of a bottling plant and dispensed into an individual container, e.g., a cup or glass for the end consumer. The dispense head can either be stationary, that is, mounted to some stand or dispensing machine where the cup is moved into a proper orientation for receiving the beverage; or mobile, where the dispense head is connected to the end of a length of hose and can be manually manipulated into a proper dispensing orientation for the cup. The nozzle of the dispense head generally directs a diluent such as carbonated water or plain water, and one or more concentrated flavors and/or sweeteners, together into a cup. The concentrate is typically mixed in a ratio of about 1:5 with the diluent, although this can vary with the concentrate and diluent.

Patent specification U.S. Pat. No. 4,218,014, for example, shows a dispensing head for multiple flavors where a diluent is directed through an outlet passage in a nozzle to individual outlet runners spaced around a convex conical bottom surface of the nozzle and directed outwardly away from the centerline of the nozzle. A plurality of concentrate outlets are also provided around the convex conical bottom surface of the nozzle in alternating relation with the diluent outlets. A spout with a bottom opening surrounds the nozzle and extends downwardly past the bottom surface of the nozzle and concave inwardly to define a torroidal diluent flooding chamber. The diluent is introduced through the outlet passage and outlet runners to the flooding chamber and against the flooding chamber concave wall surfaces, which shape and direct the flow. The diluent flow then discharges in "an absolutely straight column" from the bottom opening in the spout. The concentrate stream is directed at high velocity through the flowing water and also against the inner concave surface of the spout, which shapes the concentrate into a "disc shape" within the nozzle and directs the concentrate into the water stream, where it is dissolved and discharged with the water through the bottom opening in the spout.

Patent specification GB 2269761 also shows a multi-flavor dispensing nozzle where concentrate is directed through individual centrally-located passages, and diluent is directed through individual peripheral passages, spaced around the central passages. The concentrate and diluent are mixed together in a mixing cavity formed by the housing of the nozzle before being directed downstream out of the nozzle.

A single-flavor mixer nozzle is shown in patent specification GB 2244977, where concentrate is first directed into a syrup accumulator chamber, and then directed past a syrup diverter into a mixing chamber to mix with a first flow of diluent from a accumulator chamber, the first mixture then being directed to an annular discharge orifice creating a "donut-shaped" flow pattern. The first mixture is then mixed with a second flow of diluent passing around a bulb-shaped nozzle cone which causes the second diluent to flow in a cone-shaped column which converges with the donut-shaped flow of the first mixture, and then mixes with the first mixture as the combined mixture falls downwardly into the cup.

Other known single-flavor dispensing valves are shown in patent specification U.S. Pat. No. 4,936,488, where in one embodiment a water port is concentric with and partially surrounds a central concentrate port, with the concentrate port being inwardly set from the water port for at least initially mixing the concentrate and diluent within the nozzle; and in another embodiment a conical nozzle with an inner cylindrical surface directs an outer flow of diluent in surrounding relation to a central elongated syrup diffuser, the diffuser having a syrup distributor at the tip thereof which is inwardly set from the lower opening of the nozzle - again for mixing the concentrate and diluent at least partially within the nozzle before the mixture is directed downstream.

A similar single-flavor dispensing valve is shown in patent specification U.S. Pat. No. 2,674,264, where a series of individual diluent outlet ports are evenly-spaced in a circumferential array around a central concentrate outlet port. The diluent outlet ports direct the diluent radially inward toward the concentrate in a recess of the nozzle, with the mixture then passing downstream through a lower opening in the nozzle. Patent specification GB 2256636 shows a similar structure, however the individual diluent outlet ports direct the diluent radially inward toward the concentrate at a location downstream from the nozzle head.

Some known factors which are important in beverage dispensers include mixing of the diluent and concentrate; foaming; excessive loss of carbonation; and manufacture, clean-up, and service costs. Insufficient mixing of the beverage is a particular concern and includes the problems of residue, carryover and stratification. Residue is where concentrate remains in the head after the dispense of the concentrate is complete. If a small amount of residue is present, the residue can dry within the head between beverage draws and clog the nozzle; while if a greater amount of concentrate is present, the residue can drip down into a collection tray under the dispense head or onto a countertop. These problems can be unsightly and cause unpleasant odors, and generally raise sanitary concerns. Carryover is similar, but relates to the mixing of concentrate left within the dispense head from a previous beverage of one flavor (or color) with a subsequent beverage of a different flavor and/or color. Carryover can be caused by post-dripping or by the suction produced by the beverage nozzle when dispensing one flavor, which can cause concentrate of another flavor to be drawn out of the dispense passage and carried into the beverage stream, or force the concentrate up a dispensing passage of another concentrate by back-pressure or reverse flow. These problems raise beverage quality issues when color and taste are important. Stratification is where the diluent and concentrate are not fully and evenly mixed, and the concentrate, being of a higher density, generally settles toward the bottom of the container, while the diluent is disposed towards the top of the container.

One of the more difficult of the above-mentioned problems to overcome is that of residue, that is, where some concentrate and/or mixed beverage remains on the inside surfaces of the nozzle after the dispensing process is complete, where the concentrate can dry, or coalesce and drip down from the nozzle. It is believed that this occurs because many of the prior nozzles use the inside wall surfaces of the nozzle to shape and direct the fluid flow through the nozzle during the mixing process. However, once the concentrate is mixed with the diluent and exposed to air, bacterial growth can occur. With the nozzles typically having a long, cylindrical shape with a tapered spout area, it can be difficult to adequately clean the inside wall surfaces of the nozzle without disassembling the dispense head and separately washing the nozzle in a disinfectant solution. The collection trays and countertops which collect dripping concentrate also have to be frequently cleaned and drained to prevent bacterial growth. It can therefore be difficult and time-consuming with some prior art nozzles to keep the inside surfaces of the nozzles and related equipment clean during continual usage to maintain necessary sanitary conditions and operation of the dispensing machine.

Some of the known nozzles have apparently been designed in an attempt to overcome some of the above drawbacks. However, it is believed that the known nozzles still have performance limitations in dispensing a beverage, particularly with respect to the thorough mixing of the constituent components of the beverage and the easy clean-up of the dispense head and related equipment.

As such, it is believed that there is a demand in the industry for a dispensing head for beverages which addresses many of the above drawbacks, for example the clean-up requirements and the thorough mixing of the beverage during the dispense process. Of course it is believed that there is a continual demand for new and unique post-mix dispense heads which eliminate or at least significantly reduce residue, carryover and stratification, as well as foaming and loss of carbonation, but which nonetheless provide a design which is economical to manufacture, and simple to clean and service.

SUMMARY OF THE PRESENT INVENTION

The present invention provides a new and unique post-mix beverage dispensing head having a nozzle which effectively and thoroughly mixes a diluent with one or more concentrates, and which is of simple and economical construction. The mixing of the diluent and concentrate is external to the nozzle and accomplished without any physical contact with the nozzle, that is, the present invention takes advantage of certain properties of liquids, namely surface tension, which provides for thoroughly mixing the diluent and concentrate downstream from the nozzle. Such a nozzle reduces residue, carryover and stratification of the beverage, as well as foaming and excessive carbonation loss. The lack of contact of the concentrate and diluent with the wall surfaces of the nozzle also reduces the chance for bacterial growth and facilitates cleanup of the nozzle without removal.

According to the principles of the present invention, the nozzle of the dispense head includes a diluent passage and one or more concentrate passages which extend to respective outlet ports at the lower discharge surface of the nozzle. The outlet port of the diluent passage preferably has an annular configuration which surrounds the individual outlet port(s) of the concentrate. The diluent passage directs the diluent in a thin, continuous cylinder and the diluent exits the annular outlet port in an uninterrupted thin film. The cylindrical flow of diluent is drawn together into a stream by surface tension into the shape of a "cup" downstream from the dispense head. The diluent outlet port can also be directed slightly inwardly to facilitate forming the cup at a specific location downstream from the dispense head. The concentrate stream is introduced internally of the cylindrical flow of diluent and directed toward the bottom of the diluent cup, where the concentrate is mixed with the diluent. The mixture then continues as a single stream into the beverage container (e.g., into the glass, cup, etc.).

The diluent and concentrate are introduced together at an external location which does not have physical contact with the nozzle. There is no internal mixing chamber, which reduces residue in the nozzle, and thereby reduces potential areas for bacterial growth. The nozzle also reduces carryover because the concentrate is retained within the concentrate passages, which also reduces back-pressure and reverse-flow problems. The concentrate is introduced into the diluent cup, which is a point of maximum turbulence of the diluent. This adequately mixes the concentrate into the diluent and reduces stratification in the dispensed beverage.

The outlet ports for the concentrate preferably provide a stream of concentrate into the bottom of the diluent cup, however, each port could also include a spray device, such as a pressure swirl spray, fixed pintle or a pintle valve, to cause the concentrate to be delivered into the diluent cup in a spray. In either case, the concentrate is smoothly introduced into the diluent to be thoroughly and completely mixed with the diluent.

The creation of a diluent cup also allows excess concentrate to "pool" within the bottom of the cup. The pooled concentrate then meters evenly into the diluent, which provides consistency in flavor and color of the beverage. This also allows the concentrate to be introduced in a continuous or intermittent manner, if desired.

The diluent is preferably introduced into the nozzle through an inlet port disposed along the central axis of the nozzle. The inlet flow is directed through a gradually radially-increasing, annular passage, or through radially-extending discrete passages, to a constant-diameter annular passage leading to the annular diluent outlet port. When the diluent reaches the outlet port, the diluent is essentially in a thin, continuous cylinder and exits the port in an uninterrupted thin film. The diluent is controlled through the nozzle to reduce the velocity of the diluent at the outlet port, which minimizes out-gassing, and thereby reduces carbonation loss and foaming downstream from the nozzle.

The discharge surface of the nozzle in one embodiment has a concave conical shape which tapers outwardly from the central axis of the nozzle to the inside edge of the annular diluent outlet port. In another embodiment, the outlet surface has a central flat area around the concentrate outlet ports. The surface then tapers outwardly at an annular shoulder to the inside edge of the diluent outlet port. The outlet ports of the concentrate are evenly spaced across the outlet surface close to the central axis of the nozzle or are angled slightly inwardly toward the axis. A flat, annular surface surrounds the outer edge of the diluent outlet port. The configuration of the discharge surface reduces carryover and residue by maintaining separation of the concentrate and the diluent across the outlet surface. The discharge surface is also easily accessible, which allows easy wiping of the nozzle with a sanitizing cloth without disassembling the dispense head.

The dispense head of the present invention overcomes many of the drawbacks of the prior art and provides for dispensing a beverage which is thoroughly and completely mixed. The dispense head reduces residue, carryover and stratification, as well as foaming and excessive carbonation loss. Further, the nozzle is easy to manufacture, keep clean, and service.

Further features of the present invention will become apparent to those skilled in the art upon reviewing the following specification and attached drawings.

DETAILED DESCRIPTION OF THE PREFERRED EMBODIMENT

Figure 1:
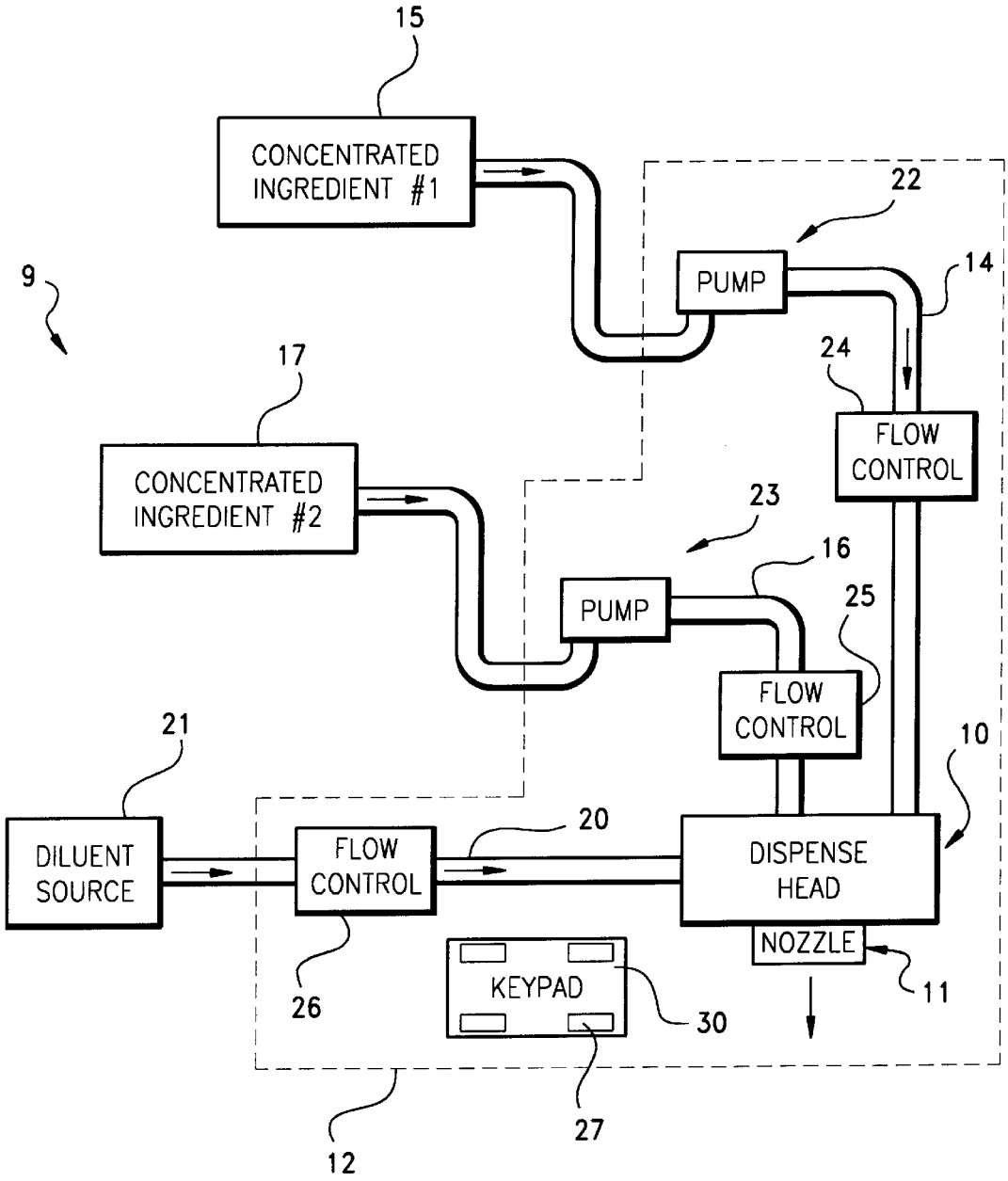
FIG. 1 is an schematic illustration of a post-mix dispense system constructed according to the principles of the present invention.

Referring to the Figures and initially to FIG. 1, a post-mix dispense system is illustrated generally at 9, incorporating a dispense head, indicated generally at 10, constructed according to the principles of the present invention. As will be described herein, the dispense head 10 is used to mix one or more liquids, such as a concentrated syrup or fruit juice, with a diluent such as carbonated water or plain water.

The dispense head 10 includes a nozzle 11 for dispensing the liquids and diluent, and a housing for the nozzle, as shown in phantom at 12. Housing 12 is typically a rectangular or square structure formed from plastic or metal, which can be conveniently located, for example, on a countertop. The nozzle 11 is remotely connected by a first conduit 14 to a first concentrate source 15, e.g., a first syrup and/or sweetener tank; by a second conduit 16 to a second concentrate source 17, e.g., a second syrup and/or sweetener tank; and by a third conduit 20 to a diluent source 21, e.g., a pressurized carbonated water tank. Pumps 22, 23 operate to draw the concentrate from the concentrate tanks 15, 17, respectively; while flow controls 24, 25 and 26 meter the flow of the liquids from the concentrate and diluent tanks 15, 17, 21, respectively, to nozzle 11. A pump may also be provided for diluent tank 21 in the event the tank is not appropriately pressurized. Pumps 22, 23 and flow controls 24–26 can be actuated by one or more press switches 27 mounted on a keypad 30. Pumps 22, 23, flow controls 24–26, switches 27 and keypad 30 are commercially-available components which should be well-known to those of ordinary skill in the art. Resort may be had to U.S. Pat. Nos. 4,173,296 and 4,936,488 which show and describe exemplary types of pumps, flow controls, switches and keypads.

As is well-know, a customer can dispense a beverage from dispense head 10 by locating a container, e.g., a cup or glass (not shown), under nozzle 11, and engaging one of the press switches on keypad 30, at which point the beverage will dispense from the nozzle 11 by the action of pumps 22, 23 and flow controls 24, 25, 26. The flavor of the beverage will be dependent upon the particular concentrate chosen for the diluent. While two concentrate sources are described above, this is merely for exemplary purposes, and as will be described below, the invention contemplates one or more concentrates sources, each of which would be connected through a respective conduit to the dispense head and controlled through appropriate pumps and flow controls, and all of which would be operable by press-switches on keypad 30. The beverage recipe may require only a single concentrate to be mixed with the diluent, or could require two or more concentrates to be simultaneously mixed with the diluent.

Moreover, while the dispense head described above is a fixed (non-moveable) dispense head, which is the preferred form of the invention, the present invention is also applicable to mobile or portable dispense heads. In this case, the dispense head 10 is manually supported by the user and moved into orientation over the container to dispense the beverage. The dispense head would include a nozzle and a small, hand-held housing enclosing the nozzle, with an integral keypad to control the dispensing of the beverage. Such a mobile type of dispense head housing should be well-known to those of ordinary skill in the art, and is not further described herein for sake of brevity.

In any case, the nozzle 11 for the dispense head 10 will now be more fully described. As shown in FIGS. 2–5, nozzle 11 includes an inner cylindrical body 32 surrounded by an outer cylindrical skirt 33. Nozzle 11 circumscribes a central axis "A" and is generally supported within the dispense head such that the nozzle has an upper, inlet end 35 and a lower, outlet end 36. The nozzle includes at least one concentrate passage such as indicated at 37*c*, and a single diluent passage 38. Concentrate passage 37*c* extends downwardly through nozzle 11 from a first inlet port 40*c* at the upper end 35, through body 32 and skirt 33, to lower end 36; while diluent passage 38 extends downwardly through nozzle 11 from a second inlet port 42 in the upper end 35, between body 32 and skirt 33, to the lower end 36. Concentrate conduit 14 is connected by tube 43*c* to inlet port 40*c* to fluidly connect concentrate source 15 to the nozzle. Diluent conduit 20 is similarly connected by tube 44 to diluent inlet port 42 to fluidly connect the diluent source 21 to the nozzle. Tubes 43 and 44 are closely received within their respective conduits and within their respective ports to provide a fluid-tight seal therewith. Alternatively, conduits 14, 20 could be connected directly to their respective ports, or appropriate fittings could be used. These alternatives should be well-known to those of ordinary skill in the art.

An annular, outwardly-projecting flange 47 is provided around skirt 33 to facilitate mounting nozzle 11 to dispense head 10. Bayonet pins 48 are also provided for these purposes. Bayonet pins 48 can be received within appropriate slots in the dispense head to allow the nozzle to be easy attached to and removed from the dispense head.

Diluent passage 38 initially has the shape of a cylindrical bore and is disposed along the central axis of the nozzle. Passage 38 is then directed between inner body 32 and outer skirt 33 in a radially-enlarging annular passage portion 50 to a constant-diameter annular portion 52. The passage has smoothly-tapering walls between inlet port 42 and upstream annular portion 50, and between upstream annular portion 50 and downstream annular portion 52. The gradual tapering of the walls of passage 38 minimizes stress and turbulence in the diluent, which minimizes out-gassing from the diluent. It is preferred that this angle not be more than 30 degrees to the central axis of the nozzle, and that the annular portion extend from a location close to the upper end 35 of the nozzle to about the midpoint of the nozzle, although this could vary depending upon the length of the nozzle. The downstream annular portion 52 extends the remainder of the length of the nozzle between inner body 32 and skirt 33 to an outlet port 54 at the lower end 36 of nozzle 11. The flow area through upstream annular portion 50 and downstream annular portion 52 is preferably greater than through inlet port 42, which reduces the velocity of fluid through the nozzle—thereby also reducing stress and turbulence on the diluent.

Outlet port 54 preferably has an annular configuration, and is outwardly bounded by a flat annular discharge surface 56, perpendicular to the central axis of the nozzle, which forms a sharp annular edge 57 defining the outer diameter of the port. The outlet port is also inwardly bounded by an inner discharge surface 58, which also forms a sharp annular edge 59 defining the inner diameter of the port. The configuration of the inner discharge surface 58 will be more fully described below. The dimensions (e.g., length, mean radius, diameter, etc.) of inlet port 42, upstream annular portion 50, downstream annular portion 52 and outlet port 54 can vary depending upon the desired flow characteristics, as should be appreciated by those skilled in the art.

Figure 3:
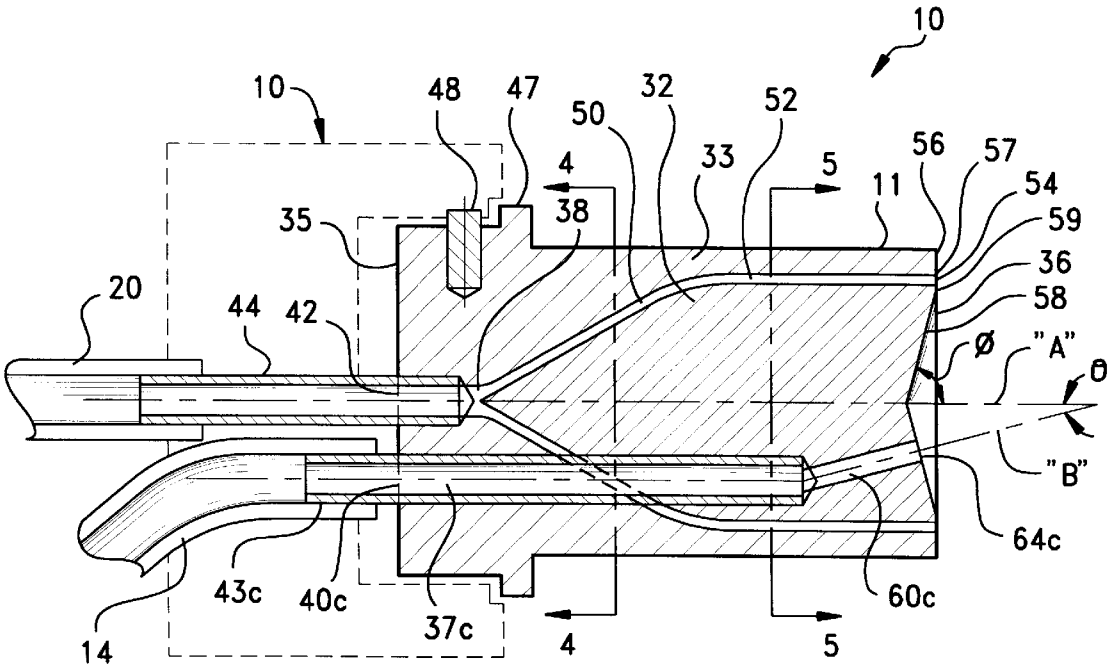
FIG. 3 is a cross-sectional side view of the nozzle taken substantially along the plane described by the lines 3—3 in FIG. 2.

Concentrate passage 37*c* is generally in the shape of a cylindrical bore of constant diameter. Passage 37*c* extends axially through the nozzle to an end portion 60*c*, which then extends at a slight angle and terminates at a circular outlet port 64*c* in inner discharge surface 58. Passage 37*c* is preferably spaced as close as possible to the central axis of the nozzle, with the distance from the central axis generally being dependent upon the number of concentrate passages through the nozzle, and the manufacturing tolerances necessary to manufacture the nozzle. Outlet port 64*c* will generally be closer to the central axis of the nozzle because of the inward angle of passage end portion 60*c*. As shown in FIG. 3, inner discharge surface 58 has a conically-tapered configuration, with passage end portion 60*c* intersecting surface 58 substantially perpendicular thereto. The conical lower end surface 58 of the nozzle preferably forms an angle "ϕ" of no less than 65 degrees with the central axis, and preferably forms an angle of between 65 and 80 degrees with the central axis, such that the axis "B" of passage end portion 60*c* forms an angle "0" of not more than 25 degrees, and preferably forms an angle of between 10 and 25 degrees, with the central axis "A" of the nozzle. This ensures that fluid exiting passage 60*c* through port 64*c* flows essentially along, or at least parallel to, the central axis of the nozzle, and does not have a substantial radial component of motion.

Concentrate conduit tube 43 is closely received in passage 37*c* and extends through the passage substantially to end portion 60*c*. The dimensions (e.g., length, mean radius, diameter, angle, etc.) of inlet port 40*c*, concentrate tube 43, end portion 60*c* and outlet port 64*c* can also vary depending upon the desired flow characteristics, as should be appreciated.

Figure 2:
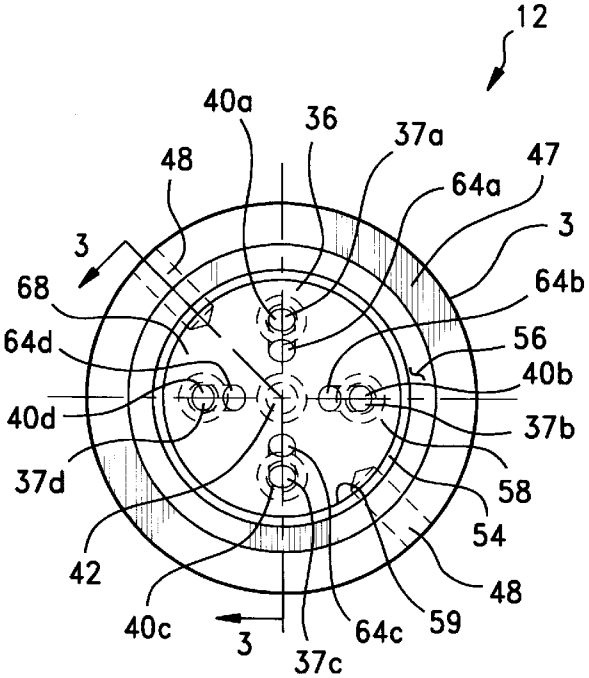
FIG. 2 is a lower end view of the nozzle for the dispense head of FIG. 1.
Figure 5:
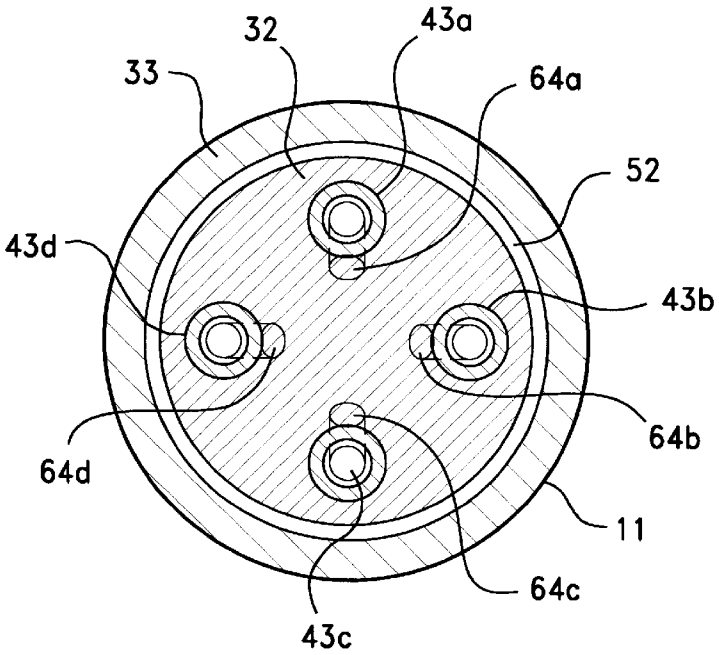
FIG. 5 is a cross-sectional end view of the nozzle taken substantially along the plane described by the lines 5—5 of FIG. 3.
Figure 4:
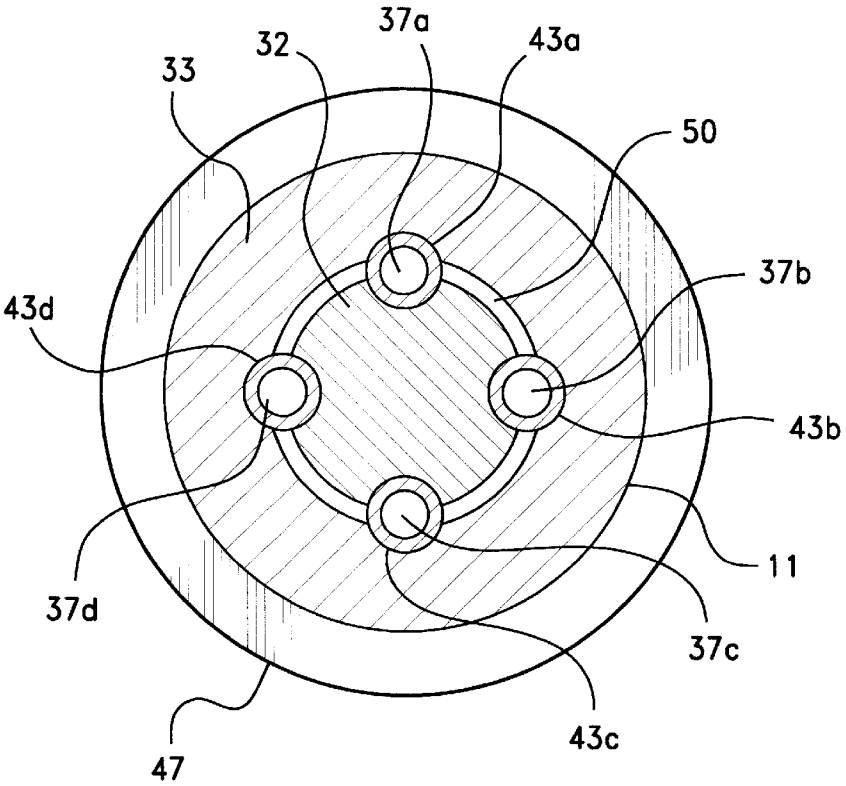
FIG. 4 is a cross-sectional end view of the nozzle taken substantially along the plane described by the lines 4—4 in FIG. 3.

While only a single concentrate passage 37*c* is described above and may be useful in some applications, nozzle 11 can also include a plurality of concentrate passages, for example as shown at 37*a*, 37*b* and 37*d* in FIGS. 2, 4 and 5, extending axially through the nozzle. Concentrate passages 37*a*–37*d* each have an inlet port as at 40*a*–40*d*, and an inwardly-directed end portion 60*a*–60*d*, leading to a respective outlet port 64*a*–64*d* close to the central axis. Each inlet port 40*a*–40*d* is fluidly connected by a tube 43*a*–43*d* to a respective conduit to receive a concentrate, and directs the concentrate to a respective outlet port 64*a*–64*d* along inner discharge surface 58. FIGS. 2–5, for example, illustrate a second conduit 16 fluidly connecting a second concentrate source 17 to nozzle 11. Second conduit 16 would then be connected to one of inlet ports 40*a*, 40*b*, 40*d* and to one of the concentrate passages 37*a*, 37*b*, 37*d*, which would direct the second concentrate to one of the outlet ports 64*a*, 64*b*, 64*d*. The outlet ports 64*a*–64*d* are preferably evenly-spaced around the discharge surface and are each directed inwardly along an axis "B" at a slight angle to central axis "A", as described previously with respect to passage 37*c*. FIGS. 2, 4 and 5 show four concentrate passages 37*a*–37*d* connected to four outlet ports 64*a*–64*d*, although again this could change depending upon the number of concentrates desired for the dispense head.

Annular diluent outlet port 54 preferably surrounds all of concentrate outlet port(s) 64*a*–64*d*, as illustrated in FIGS. 2–5. The concentrate passages 37*a*–37*d* intersect diluent passage 36 along the upstream tapered annular portion 50, to fluidly connect concentrate inlet ports 40*a*–40*d*, which are spaced radially outward from diluent inlet port 42, with concentrate outlet ports 64*a*–64*d*, which are spaced radially inward of (surrounded by) diluent port 54. The tubes 43*a*–43*d* in concentrate passages 37*a*–37*d* extend through the intersection with diluent passage 38 to fluidly separate concentrate passages 37*a*–37*d* from the diluent passage 38. The intersection of concentrate passages 37*a*–37*d* with diluent passage 36 along the upstream, tapered annular portion 50, that is, prior to downstream, constant-diameter annular portion 52, also minimizes the stress and disruption of diluent flowing through passage 38. When the diluent in passage 36 reaches annular outlet port 54, the diluent is essentially in a thin, continuous cylinder and exits the outlet port in an uninterrupted thin film.

Nozzle body 32 and skirt 33 are formed of an appropriate material using conventional techniques. The material preferably has appropriate chemical resistance, ease of manufacture, and meets the appropriate sanitary codes for the particular application. Preferably this material is a plastic such as Delrin™, which can be easily manufactured by injection-molding. The use of this type of plastic allows the body and skirt to be formed of two parts and then easily press-fit together in a fluid-tight manner. It is also believed that the two-piece design of the nozzle body is relatively easy to manufacture, and minimizes assembly steps, however, it should be appreciated that the nozzle could also be formed from a single piece. Again other materials and techniques may be appropriate, as should be known to those skilled in the art.

The concentrate and diluent conduits 14, 16, 20 are also preferably formed of appropriate material, such as thin plastic or rubber piping, while tubes 43, 44 are preferably formed from stainless steel. The tubes are press-fit in their respective passages and with the conduits. The concentrate tubes 43 extend through both the body 32 and skirt 33 to retain these components together. The close fit of conduits 14, 16, 20 and tubes 43, 44 prevent fluid leakage around these components and cross-contamination of the concentrate and diluent, as well as leakage from the nozzle. Appropriate stand-offs can be provided between the body 32 and the skirt 33 along upstream annular portion 50 and downstream annular portion 52 to maintain an even separation between the body and skirt.

Figure 13:
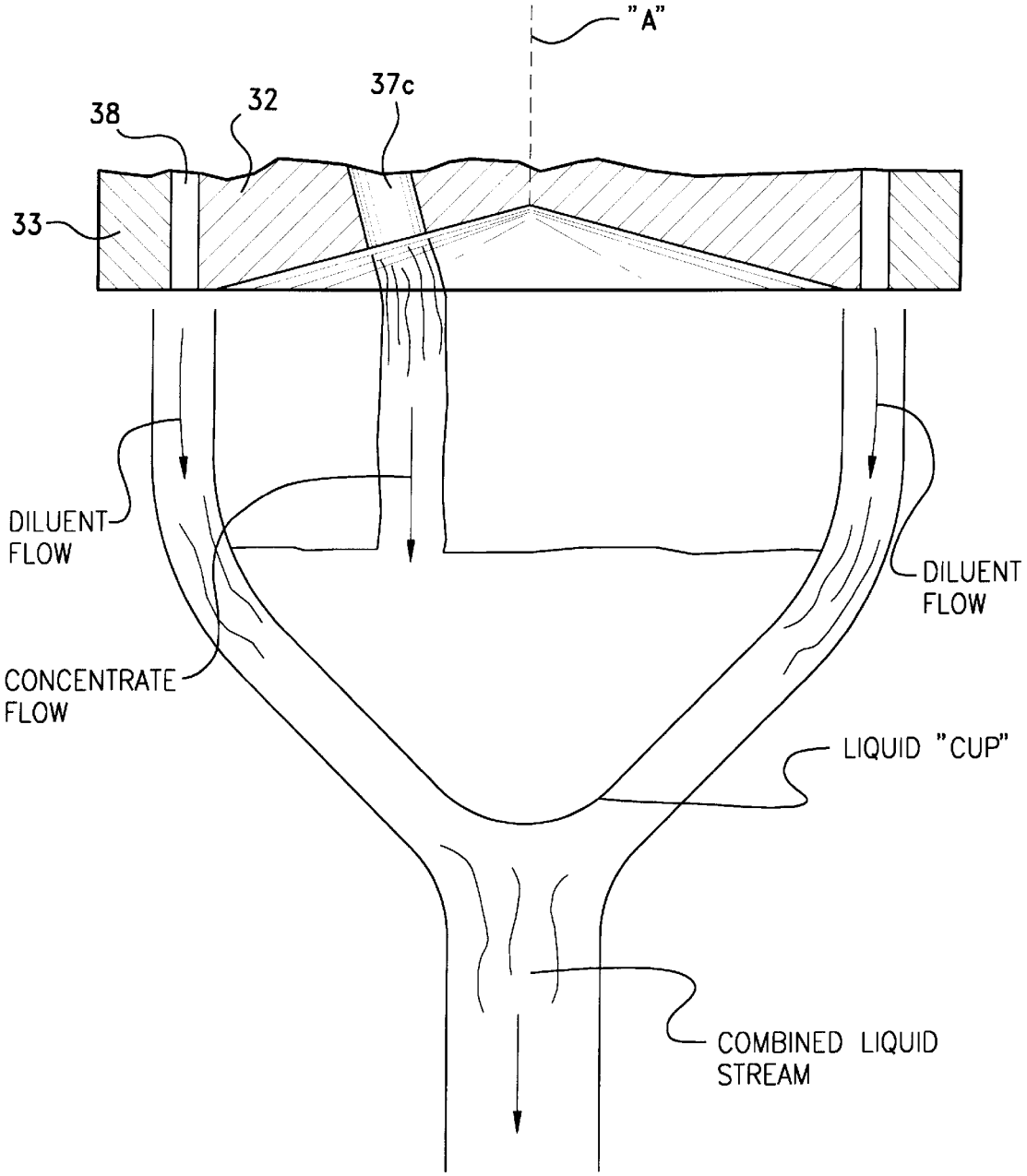
FIG. 13 is a schematic illustration of the operation of the nozzle for the dispense head of FIG. 1.

The operation of nozzle 11 will now be briefly described, with reference also to FIG. 13. When it is desirable to dispense a beverage, diluent from source 21 is fed through conduit 20 to diluent passage 38, where the diluent passes through tapered passage 50 to constant-diameter passage 52. The diluent is then discharged through annular outlet port 54 in a cylindrical thin-film. Through gravity, the diluent falls downwardly away from the dispense head. Because of the surface characteristics of liquids, namely surface tension, the flow of diluent generally is drawn together into a single stream and combines into the shape of a cup, downstream from the nozzle. The cup occurs without physical supporting structure of the nozzle and is formed entirely by the physical properties of the liquid.

The shape of the diluent cup, that is, its diameter, length (i.e., location of the cup "bottom") and the radial thickness of the cylindrical flow of diluent are determined by various factors such as: i) the type of liquid, for example, the relative proportions of water and carbon dioxide in carbonated water; ii) the velocity of the diluent through the diluent passage 38; iii) the pressure and temperature of the diluent; and iv) the dimensions of the outlet port 54 (inside and outside diameter and mean radius), among others. For common carbonated water and concentrated syrup for color, under normal operating ratios of concentrate to diluent (about 1:5), pressures, temperatures (<40 degrees F), and rates of discharge (1.5 oz. to 6 oz. mixed beverage per second), it is preferred that the diluent outlet port have an outer diameter of 1.20 inches and a inner diameter of 0.95 inches, and that the concentrate outlet ports have a diameter of between 0.05 inches to 0.15 inches. This means in a broad sense that the mean diameter of the annular outlet port is relatively large when compared to the diameter of the outlet ports for the concentrate. With a conical end surface 58 having an angle of about 65 degrees from the central axis, this creates a diluent "cup" having a bottom about 0.5 to 1.0 inches from the lower, outlet end 36 of the nozzle.

The concentrate flow from one of the concentrate sources 14, 16, is started just after the diluent flow is started. The concentrate flows through one of the passages 37*a*–37*d* to one of the outlet ports 64*a*–64*d*. The concentrate, in a thin stream, is then added to the diluent flow internally of the "cup". The concentrate is directed essentially along or parallel to the central axis of the nozzle, or at least at only a small angle with respect to the central axis, such that the concentrate stream falls downwardly under gravity generally into the central area of the cup. It is believed that the small introduction angle of the concentrate into the diluent cup prevents the concentrate from piercing the sidewall of the diluent cup and/or deforming the generally uniform nature of the diluent cup. At a preferred angle of less than 25 degrees from the central axis, the concentrate smoothly enters the diluent primarily at the bottom of the cup and with generally little disturbance of the diluent. The formation of the cup is generally at the location of greatest turbulence of the diluent flow (i.e., at the coming-together of the "cup"), which facilitates mixing the concentrate into the diluent. The combined mixture of concentrate and diluent then continues in a homogenous, single stream downwards from the cup into the beverage container.

One of the benefits of the present invention is if the concentrate is added too quickly to the diluent, or if the concentrate is added to the diluent in a non-uniform manner (e.g., if the upstream pump or valve components for the concentrate create a "pulse" of concentrate), whether intentional or not, the concentrate "pools" within the bottom of the diluent cup and is then metered into the stream of diluent passing downstream from the cup. The nozzle therefore automatically compensates for the non-uniform or irregular dispensing of concentrate to ensure that the concentrate smoothly and evenly enters the diluent. It is believed that the length of the diluent cup can also vary slightly during dispensing without effecting the mixing of concentrate.

When the beverage is fully dispensed, the consumer removes the container and the flow controls 24, 25, 26 prevent further flow of diluent and concentrate through the nozzle. When the concentrate and diluent are shut-off, only the end surface 58 of the nozzle body is potentially covered with concentrate and diluent. The diluent is in fact generally limited to the area between the inner and outer edges of the diluent outlet port, while the concentrate is retained mostly within the concentrate passages. The end surface can be easily accessed and wiped clean with a sanitizing sponge. There is no mixing chamber surrounding the surface to make clean-up difficult. The conical angle of surface 58 is also not so much as to discourage clean-up, but rather allows the lower end of nozzle 11 to be easily and quickly cleaned without removing the nozzle from the dispense head. Bacterial growth is thereby eliminated while the clean-up costs of the nozzle are reduced. Dripping of the mixture off of internal surfaces is also eliminated, or at least significantly reduced, which also minimizes residue.

In addition, the sharp inner and outer edges (57, 58) bounding the diluent outlet port 54 separate the diluent from the concentrate after shut-off, which prevents the diluent from draining inward and mixing with any concentrate drops at the outlet ports for the concentrate. This further prevents liquid carryover between the concentrate and diluent, as well as between the different concentrates.

The diluent is discharged from the diluent outlet port at relatively slow velocities because of the configuration of diluent passage 38 and the relatively large mean diameter of the diluent outlet port compared to its width. This also minimizes gas loss from the diluent, as well as foaming.

The above dimensions and other characteristics of the concentrate and diluent outlet ports are only provided herewith as examples, and can vary as necessary or desirable. Also, while the diluent outlet port 54 is shown in FIG. 2 as having an annular configuration, it is also anticipated that this port could have other continuous configurations, such as square, rectangular, star-shaped or lobe-shaped, which would also completely surround the concentrate outlet ports 64*a*–64*d* and produce a continuous thin-film cylinder of diluent around the concentrate stream(s).

Figure 6:
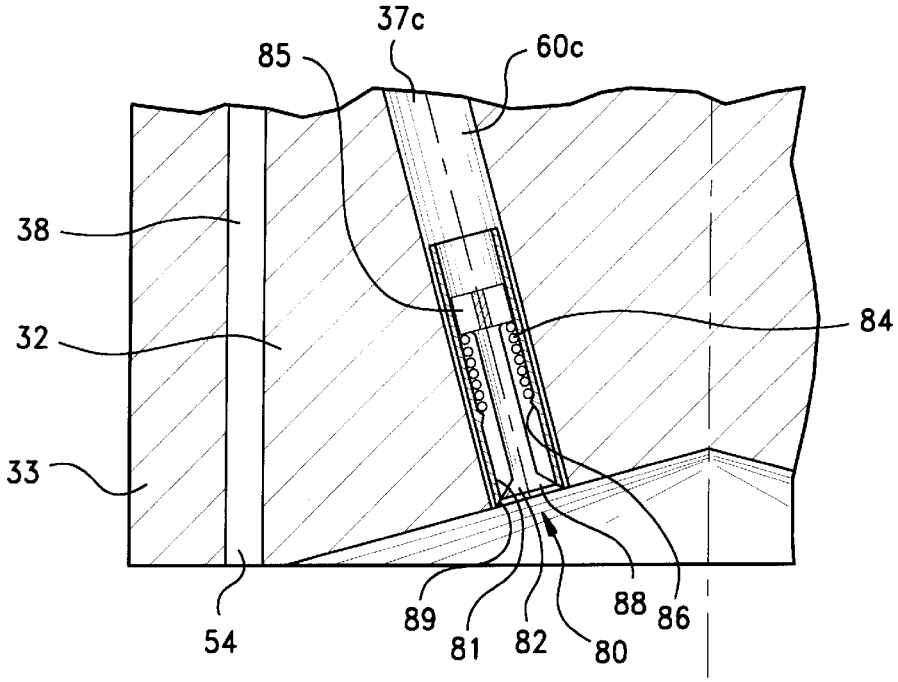
FIG. 6 is a cross-sectional enlarged side view of a portion of the nozzle for the dispense head of FIG. 1, showing a further aspect of the nozzle with a valve in a closed position.

In the first form of the nozzle described above with respect to FIGS. 2–5, the concentrate outlet ports 64*a*–64*d* are illustrated as having a circular opening which formed the concentrate into a solid, generally cylindrical stream. It is also anticipated that the outlet ports for the concentrate could have other configurations, e.g., square, triangular, etc., or could supply the concentrate in a spray internally of the diluent. With respect to this latter point, referring now to FIGS. 6 and 7, a spray valve, indicated generally at 80, could be located in one, some, or all of the concentrate passages 37*a*–37*d*. The spray valve is illustrated as including a cylindrical housing 81 which is closely received within passage 37, and which surrounds a pintle stem 82. Pintle stem 82 is normally biased by a light compression spring 84 into a closed position, as shown in FIG. 6. Spring 84 extends between a cross or X-shaped upper end 85 of the stem to an annular shoulder 86 provided internally of the valve housing. A conical valve head 88 on the pintle stem seals against a valve seat defined at the open end 89 of housing 81. The valve head 88 could also seal directly to the portion of the end surface 58 surrounding passage 37.

Figure 7:
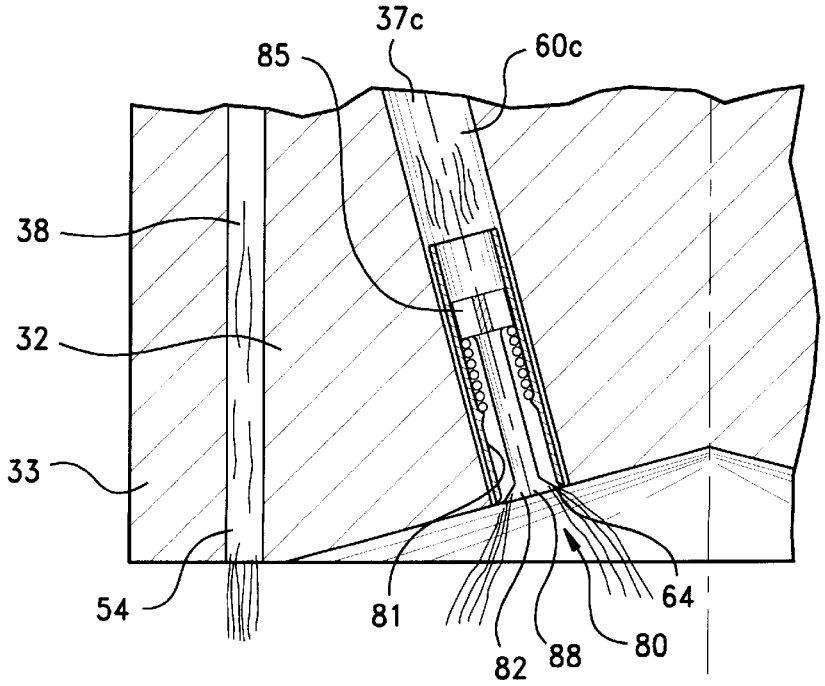
FIG. 7 is a cross-sectional enlarged side view of the nozzle similar to FIG. 6, but showing the valve in an open position.
Figure 8:
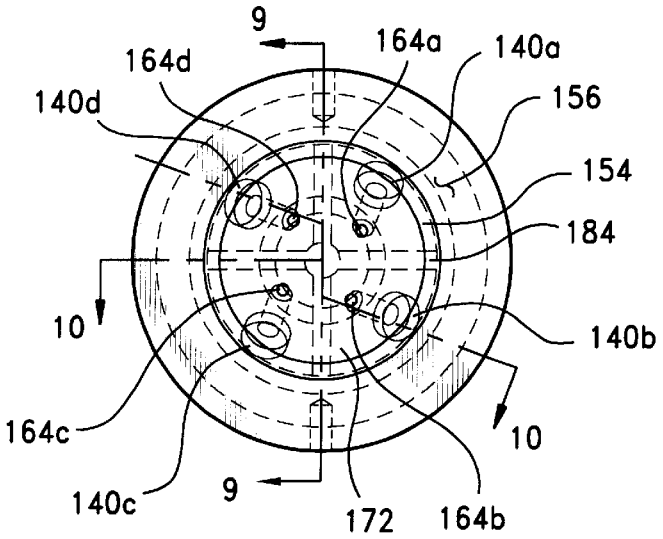
FIG. 8 is a lower end view of a further embodiment of the nozzle for the dispense head of FIG. 1.
Figure 11:
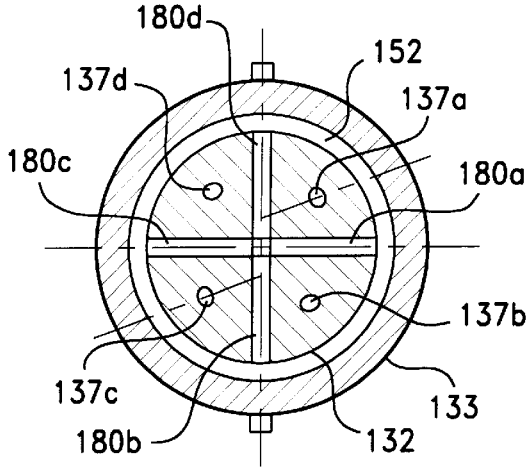
FIG. 11 is a cross-sectional end view of the nozzle taken substantially along the plane described by the lines 11—11 in FIG. 9.
Figure 12:
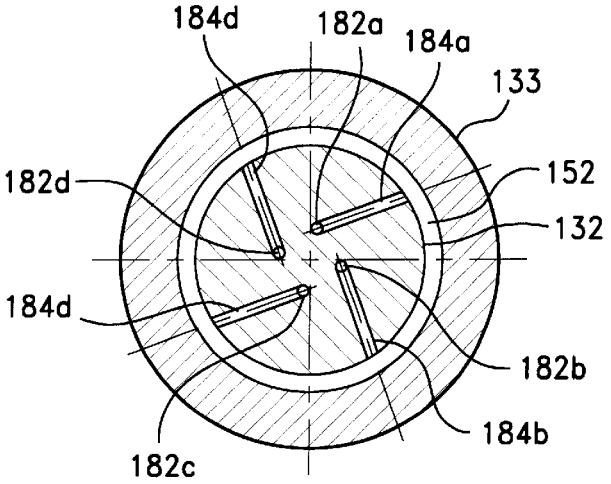
FIG. 12 is a cross-sectional end view of the nozzle taken substantially along the plane described by the lines 12—12 in FIG. 10.
Figure 9:
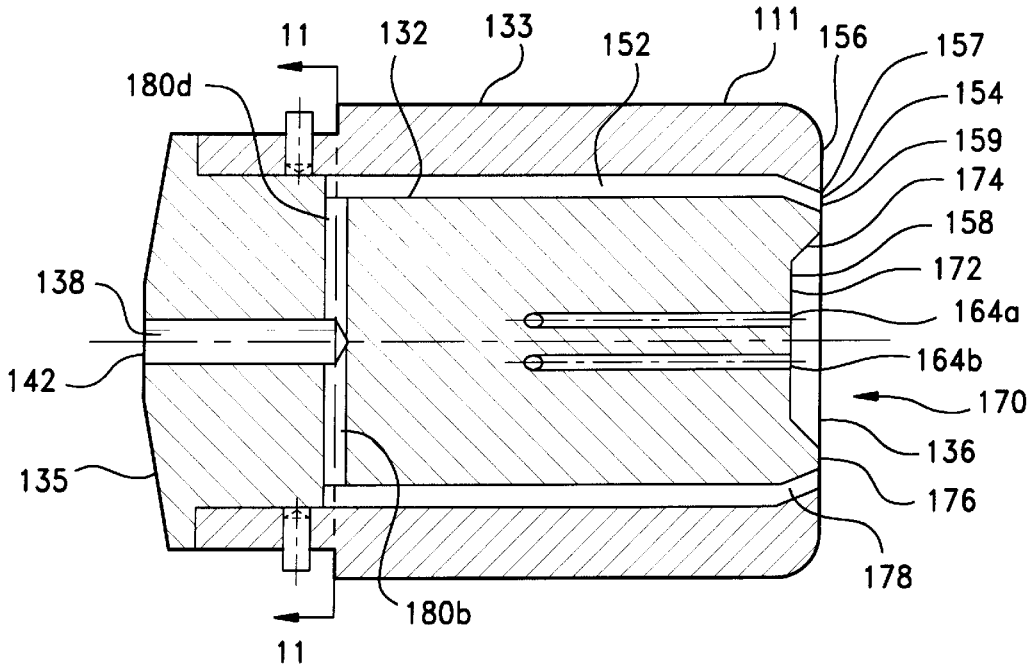
FIG. 9 a cross-sectional side view of the nozzle taken substantially along the plane described by the lines 9—9 in FIG. 8.
Figure 10:
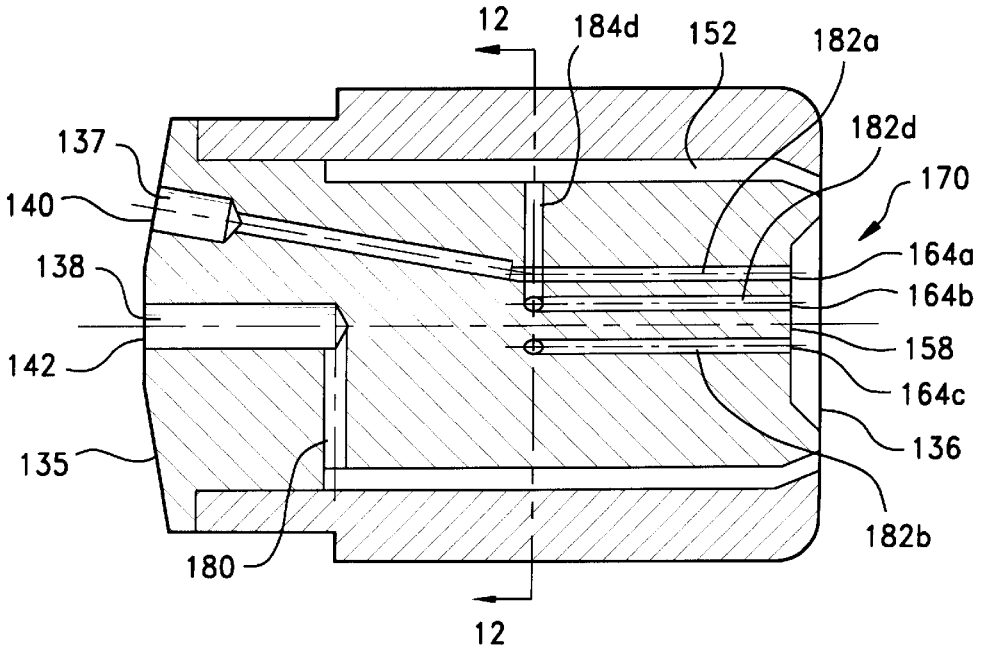
FIG. 10 is a cross-sectional end view of the nozzle taken substantially along the plane described by the lines 10—10 in FIG. 8.

When concentrate of a pressure above the spring constant of the spring is directed through passage 37, the pintle stem 82 moves to the position shown in FIG. 7, where fluid can flow around the valve head 88 and exit outlet port 64. The conical configuration of the valve head directs the concentrate in a even conical spray downstream from the nozzle, where the concentrate then impinges against the inside walls of the diluent "cup", as well as at the bottom of the cup. With such conical spray, the concentrate evenly and smoothly enter the diluent—again without substantially disturbing the diluent. When the fluid pressure falls below the constant of the spring, the pintle stem moves into the closed position (FIG. 6), and seals against the housing to prevent dripping of the concentrate. This further prevents cross-contamination of the different concentrates and the diluent.

Of course, the above is only one type of spray device for introducing the concentrate into the diluent which is of simple manufacture and assembly. Other spray devices could likewise be appropriate, for example pressure-swirl or fixed pintle sprays, as long as the concentrate is evenly and smoothly introduced into the diluent internally of the "cup", and downstream (external) of the nozzle.

A further embodiment of the nozzle for the dispensing head of the present invention is indicated generally at 111 in FIGS. 8–12. In this embodiment, nozzle 111 is similar to nozzle 11 of the first embodiment in that it includes an inner cylindrical body 132 and an outer cylindrical skirt 133 which are press-fit together, and the following discussion will focus mainly on the differences between the nozzles. The differences primarily relate to the discharge surface 158 at the lower end 136 of the nozzle 111. The discharge surface 158 includes a recess, indicated generally at 170, having a flat circular central portion 172, which is concentric with the central axis of the nozzle. The discharge surface also has an annular tapered shoulder 174 which interconnects central portion 172 with a flat annular surface 176 inwardly bounding the inner edge 159 of annular diluent outlet port 154. Annular portion 174 preferably tapers outwardly at an angle of about 45 degrees from central portion 172, although this angle could vary slightly as should be appreciated. Flat annular portion 156 outwardly bounds the diluent outlet port 154, as in the first embodiment above, and again forms a sharp edge 157 therewith.

At the distal end of the cylindrical portion 152 of the diluent passage 138, that is, close to outlet port 154, the cylindrical portion 152 narrows slightly and is angled radially-inward at 178 toward the central axis of the nozzle. Preferably the passage is angled inwardly at an angle of about 30 degrees to the central axis, and extends along this angle until the outer edge 157 of the diluent outlet port 154 is located radially inward of the inner diameter of passage 152, so that there is no "see-through" of the passage. This in effect causes the entire diluent flow through passage 152 to have a component of motion directed inwardly toward the central axis of the nozzle. The inward angle of the diluent port allows the location of the "cup" formed downstream of the nozzle to be accurately controlled. The cup can be caused to form at a location closer to the end of the nozzle than if surface tension alone were involved, to facilitate causing the concentrate and diluent to mix together closer to the nozzle. This has been found to be particularly advantageous when non-carbonated water (plain water) is used as the diluent. Such water has a higher surface tension, and needs to be carefully controlled in order to create a proper "cup" downstream of the nozzle.

The concentrate outlet ports 164*a*–164*d* are located within the central circular flat portion 172 of the discharge surface, preferably close to the central axis of the nozzle, such that concentrate flow is essentially along the central axis. The outlet ports could also be angled slightly inward toward the central axis, as described above with respect to the first embodiment, as long as the concentrate falls under gravity generally into the bottom of the diluent cup. The configuration of the discharge surface again prevents the diluent from draining inward and mixing with drops of concentrate formed at the outlet port for the concentrate. The concentrate is also mostly retained within the concentrate passages. As in the first embodiment, this prevents liquid carryover between the concentrate and diluent as well as between the different concentrates.

Nozzle 111 also includes slightly different passages for the diluent and concentrates, particularly at the inlet end 35. Specifically, diluent inlet port 142 is located along the central axis of the nozzle as in the first embodiment, however, this passage 138 is then connected by a series of discrete, radially extending passages 180*a*–180*d* to the downstream annular passage 152, rather by a radially-enlarging annular passage as in the first embodiment. Four discrete passages 180*a*–180*d* are shown, however, the number of these passages can vary depending upon the particular application. In any case, discrete passages 180*a*–180*d* provide diluent to annular portion 152 such that the diluent can then flow downstream through passage 152 in a continuous cylinder, and then exit annular outlet port 154 in an uninterrupted thin-film. Again, this minimizes the stress and disruption of diluent flowing through passage 138.

Concentrate passages 137*a*–137*d* are similar to passages 37*a*–37*d* as in the first embodiment, however, these passages extend at a slight angle inwardly toward the central axis from inlet ports 140*a*–140*d* to end portions 182*a*–182*d*, respectively. The concentrate passages 137*a*–137*d* extend between each of the discrete diluent passages 180*a*–180*d*, as shown most clearly in FIG. 11, and are thereby fluidly separated therefrom. End portions 182*a*–182*d* interconnect passages 137*a*–137*d* with the discharge surface 158 of the nozzle, and open to concentrate outlet port(s) 164*a*–164*d*. To facilitate fluidly interconnecting passages 137*a*–137*d* with end portions 182*a*–182*d*, radially-directed bores 184*a*–184*d* can be formed (drilled) through body 132 to interconnect these passages during manufacture, and then these bores can be fluidly sealed with plugs (not shown). The configuration of the passages through the nozzle in this embodiment facilitates forming body 132 and skirt 133 in an efficient, cost-effective manner. Again, the nozzle is easy to manufacture using common techniques, which should be well-known to those skilled in the art.

The remaining structure of the nozzle 111 in this embodiment is preferably the same as in the first embodiment, and the fuction of the nozzle to create a cup of diluent into which the concentrate is added downstream from the nozzle without any physical contact therewith, is also the same, and is generally illustrated with reference to FIG. 13.

In either of the embodiments described above, the mixing of the concentrate and diluent downstream of the nozzle head using primarily surface tension eliminates residue as there are no wall surfaces to collect spurious concentrate; eliminates carryover as there are no cavities or chambers to cause suction, backflow or reversal of liquid; and thoroughly mixes the concentrate into the diluent at a point of maximum turbulence of the diluent passage such that stratification does not occur. The configuration of the diluent passage through the nozzle allows the diluent to be dispensed at a relatively slow rate, while the pooling of excess concentrate in the cup allows the concentrate to be smoothly and evenly introduced into the diluent, which reduces foaming and excessive loss of carbonation. There is also no internal wall surface for the mixture to collect and drip after the dispense process is complete.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A beverage dispense head for mixing a first liquid and a second liquid, comprising:

a nozzle having a first inlet port for the first liquid and a second inlet port for the second liquid, a first liquid outlet port and a second liquid outlet port, said second liquid outlet port defining a continuous opening surrounding the first liquid outlet port; a first flow passage in the nozzle interconnecting the first liquid inlet port and the first liquid outlet port, and a second flow passage in the nozzle, fluidly separate from the first passage, interconnecting the second liquid inlet port and the second liquid outlet port, said second liquid outlet port having a configuration which can form a continuous outlet flow of second liquid completely surrounding an outlet flow of first liquid from the first liquid outlet port, said outlet flow of second liquid combining under surface tension into a single stream downstream from the nozzle, the combining of the second liquid into the stream forming a cup-shape, with the first liquid being introduced through the first liquid outlet port internally of the cup to be mixed together with the second liquid and passed downstream from the nozzle in a combined stream, and wherein said nozzle includes a discharge surface and the first and second liquid outlet ports open to the discharge surface, said discharge surface having a concave tapered shape.

2. The beverage dispense head as in claim 1, wherein the cup is freely-supported externally of the nozzle and is formed only from the surface tension of the second liquid.

3. The beverage dispense head as in claim 1, wherein said second liquid outlet port defines an annular opening.

4. The beverage dispense head as in claim 3, wherein said second flow passage includes an upstream annular passage portion extending from said second liquid inlet port which tapers outwardly in a gradual manner to a constant-diameter downstream annular portion extending to the second liquid outlet port.

5. The beverage dispense head as in claim 4, wherein the nozzle has a generally cylindrical configuration with the second inlet port of said second flow passage disposed generally along a central axis of the nozzle, and the first flow passage intersects the second flow passage between the first liquid inlet port and the first liquid outlet port.

6. The beverage dispense head as in claim 5, wherein the first flow passage intersects the tapered portion of the second flow passage.

7. The beverage dispense head as in claim 3, wherein said second flow passage includes discrete, radially-extending passages extending to a downstream annular portion extending to the second liquid outlet port.

8. The beverage dispense head as in claim 3, wherein said nozzle includes a discharge surface and the first fluid outlet port is radially-inward spaced from the second fluid outlet port along the discharge surface.

9. The beverage dispense head as in claim 1, wherein said first liquid outlet port defines a circular opening directing the first liquid in a stream into the cup formed by the second liquid.

10. A beverage dispense head for mixing a first liquid and a second liquid, comprising:

a nozzle having a first inlet port for the first liquid and a second inlet port for the second liquid, a first liquid outlet port and a second liquid outlet port, said second liquid outlet port defining an continuous annular opening surrounding the first liquid outlet port; a first flow passage in the nozzle interconnecting the first liquid inlet port and the first liquid outlet port, and a second flow passage in the nozzle, fluidly separate from the first passage, interconnecting the second liquid inlet port and the second liquid outlet port, said second liquid outlet port having a configuration which can form a continuous outlet flow of second liquid completely surrounding an outlet flow of first liquid from the first liquid outlet port, said outlet flow of second liquid combining under surface tension into a single stream downstream from the nozzle, the combining of the second liquid into the stream forming a cup-shape, with the first liquid being introduced through the first liquid outlet port internally of the cup to be mixed together with the second liquid and passed downstream from the nozzle in a combined stream, wherein said nozzle includes a discharge surface and the first fluid outlet is radially-inward spaced from the second fluid outlet along the discharge surface, said discharge surface having a concave conical shape, tapering radially outward from a central axis of the nozzle to the second fluid outlet.

11. The beverage dispense head as in claim 10, wherein said discharge surface has an annular surface portion surrounding the second fluid outlet port and defining an outer edge of the second fluid outlet port.

12. A beverage dispense head for mixing a first liquid and a second liquid, comprising:

a nozzle having a first inlet port for the first liquid and a second inlet port for the second liquid, a first liquid outlet port and a second liquid outlet port, said second liquid outlet port defining an continuous opening surrounding the first liquid outlet port; a first flow passage in the nozzle interconnecting the first liquid inlet port and the first liquid outlet port, and a second flow passage in the nozzle, fluidly separate from the first passage, interconnecting the second liquid inlet port and the second liquid outlet port, said second liquid outlet port having a configuration which can form a continuous outlet flow of second liquid completely surrounding an outlet flow of first liquid from the first liquid outlet port, said outlet flow of second liquid combining under surface tension into a single stream downstream from the nozzle, the combining of the second liquid into the stream forming a cup-shape, with the first liquid being introduced through the first liquid outlet port internally of the cup to be mixed together with the second liquid and passed downstream from the nozzle in a combined stream, wherein said first liquid outlet port includes a spray device which directs the first liquid in a spray outwardly into the cup formed by the second liquid.

13. A beverage dispense head for mixing a first liquid and a second liquid, comprising:

a nozzle having a first inlet port for the first liquid and a second inlet port for the second liquid, a first liquid outlet port and a second liquid outlet port, said second liquid outlet port defining an continuous opening surrounding the first liquid outlet port; a first flow passage in the nozzle interconnecting the first liquid inlet port and the first liquid outlet port, and a second flow passage in the nozzle, fluidly separate from the first passage, interconnecting the second liquid inlet port and the second liquid outlet port, said second liquid outlet port having a configuration which can form a continuous outlet flow of second liquid completely surrounding an outlet flow of first liquid from the first liquid outlet port, said outlet flow of second liquid combining under surface tension into a single stream downstream from the nozzle, the combining of the second liquid into the stream forming a cup-shape, with the first liquid being introduced through the first liquid outlet port internally of the cup to be mixed together with the second liquid and passed downstream from the nozzle in a combined stream, and wherein said nozzle includes a discharge surface and the first and second fluid outlet ports open to the discharge surface, said wherein said discharge surface has a circular flat surface portion surrounding the first fluid outlet, and an annular tapered shoulder which interconnects the circular surface portion with the second fluid outlet.

14. The beverage dispense as in claim 13, wherein said discharge surface has an annular surface portion surrounding the second fluid outlet and defining an outer edge of the second fluid outlet.

15. A multi-flavor post-mix dispense head, comprising:

a nozzle having a plurality of first fluid inlets for first fluids and a second fluid inlet for a second fluid, a plurality of first fluid outlets and a second fluid outlet, said second fluid outlet defining an annulus surrounding the first fluid outlets; a plurality of first flow passages in the nozzle separately interconnecting each of the first fluid inlets with a respective first fluid outlet, and a second flow passage in the nozzle, fluidly separate from all of the first passages, interconnecting the second fluid inlet and the second fluid outlet, said annular second fluid outlet having a configuration which forms a cylindrical outlet flow of second fluid surrounding a fluid flow from any of the first fluid outlets, with the cylindrical outlet flow combining under surface tension into a single stream downstream from the nozzle, the combining of the second fluid into a stream defining a freely-supported cup external to the nozzle, with the first fluids respectively being introduced through the first fluid outlets internally of the cup to be mixed together with the second fluid, and passed downstream from the nozzle in a combined stream, and wherein said nozzle includes a discharge surface and the first and second fluid outlets open to the discharge surface, said discharge surface having a concave tapered shape.

16. The dispense head as in claim 15, wherein the cup is created only from surface tension of the second liquid.

17. The dispense head as in claim 16, wherein said second flow passage includes discrete, radially-extending passages extending to a downstream annular portion extending to the second fluid outlet.

18. The dispense head as in claim 15, wherein said second flow passage includes an upstream annular passage portion extending from said second fluid inlet which radially-enlarges in a tapered portion to a constant-diameter downstream annular portion extending to the second fluid outlet.

19. The dispense head as in claim 18, wherein the nozzle has a generally cylindrical configuration with the second fluid inlet of said second flow passage disposed generally along a central axis of the nozzle, and the first flow passages each separately intersect the second flow passage between the first fluid inlet and the first fluid outlet.

20. The dispense head as in claim 19, wherein the first flow passages each intersect the tapered portion of the second flow passage.

21. The dispense head as in claim 15, wherein said nozzle includes a discharge surface and the first fluid outlets are radially-inward spaced from the second fluid outlet along the discharge surface.

22. A multi-flavor post-mix dispense head, comprising:

a nozzle having a plurality of first fluid inlets for first fluids and a second fluid inlet for a second fluid, a plurality of first outlets and a second fluid outlet, said second fluid outlet defining an annulus surrounding the first fluid outlets; a plurality of first flow passages in the body separately interconnecting each of the first fluid inlets with a respective first fluid outlet, and a second flow passage in the body, fluidly separate from all of the first passages, interconnecting the second fluid inlet and the second fluid outlet, said annular second having a configuration which forms a cylindrical outlet flow of second fluid surrounding a fluid flow from any of the first fluid outlets, with the cylindrical outlet flow combining under surface tension into a single stream downstream from the nozzle, the combining of the second fluid into a stream defining a freely-supported cup external to the nozzle, with the first fluids respectively being introduced through the first fluid outlets internally of the cup to be mixed together with the second fluid, and passed downstream from the nozzle in a combined stream, wherein said nozzle has a discharge surface, said discharge surface has a concave conical shape, tapering radially outward from a central axis of the nozzle to the second fluid outlet.

23. The dispense head as in claim 22, wherein said discharge surface has an annular surface portion surrounding the second fluid outlet and defining an outer edge of the second fluid outlet.

24. A multi-flavor post-mix dispense head, comprising:

a nozzle having a plurality of first fluid inlets for first fluids and a second fluid inlet for a second fluid, a plurality of first fluid outlets and a second fluid outlet, said second fluid outlet defining an annulus surrounding the first fluid outlets; a plurality of first flow passages in the nozzle separately interconnecting each of the first fluid inlets with a respective first fluid outlet, and a second flow passage in the nozzle, fluidly separate from all of the first passages, interconnecting the second fluid inlet and the second fluid outlet, said annular second fluid outlet having a configuration which forms a cylindrical outlet flow of second fluid surrounding a fluid flow from any of the first fluid outlets, with the cylindrical outlet flow combining under surface tension into a single stream downstream from the nozzle, the combining of the second fluid into a stream defining a freely-supported cup external to the nozzle, with the first fluids respectively being introduced through the first fluid outlets internally of the cup to be mixed together with the second fluid, and passed downstream from the nozzle in a combined stream, wherein said nozzle has a discharge surface, said discharge surface has a circular flat surface portion surrounding the first fluid outlet, and an annular tapered shoulder which interconnects the circular surface portion with the second fluid outlet.

25. The beverage dispense as in claim 24, wherein said discharge surface has an annular surface portion surrounding the second fluid outlet and defining an outer edge of the second fluid outlet.

26. A method for mixing two liquids to form a beverage, comprising the steps of:

introducing a first liquid through a first flow passage in a nozzle of a beverage dispensing head to a first outlet in the nozzle, and dispensing the first liquid externally of the nozzle in a liquid stream; and introducing a second liquid through a second flow passage in the nozzle fluidly separate from the first flow passage to a second outlet in the nozzle, said second outlet having a configuration continuously surrounding the first outlet and opening into a discharge surface which has a concave tapered portion, and dispensing the second liquid externally of the nozzle in a flow path completely surrounding the first liquid stream, the second liquid in the flow path combining under surface tension into a single stream to form a freely-supported cup downstream from any supporting structure of the nozzle, and introducing the first liquid stream from the first outlet into the cup, and mixing the first and second liquids together in the cup and passing the mixture downstream of the cup in a combined stream.

27. The method as in claim 26, further including the step of creating the cup exteriorly of the nozzle using only surface tension of the second liquid.

28. The method as in claim 26, wherein the first outlet directs the first liquid in a first stream, and the second outlet has an annular configuration surrounding the first outlet, and including the step of dispensing the second fluid in a cylindrical thin film surrounding the first stream.

29. The method as in claim 28, further including the step of introducing the second liquid initially as a stream into a first portion of the second flow passage, and then directing the second liquid stream through a gradual, outwardly-tapered annular passage to a constant-diameter annular passage, and then to the second outlet.

30. The method as in claim 26, further including the step of introducing the second liquid initially as a stream into a first portion of the second flow passage, and then directing the second liquid stream through at least one radially-directed passage to a constant-diameter annular passage, and then to the second outlet.

31. A method for mixing a diluent with any of a plurality of concentrates externally of a dispensing head, comprising the steps of:

introducing one of the concentrates through one of a plurality of first flow passages in a nozzle of the dispensing head to one of a plurality of first outlets in the nozzle, and dispensing the one of the concentrates externally of the dispensing head in a liquid stream; and introducing the diluent through a second flow passage in the nozzle to a second, annular outlet in the nozzle, the annular outlet surrounding all of the first outlets and opening into a discharge surface which has a concave tapered portion, and dispensing the diluent externally of the dispensing head in a cylindrical flow path surrounding the one concentrate stream, the diluent in the cylindrical flow path combining under surface tension into a stream to form a freely-supported cup external to the dispensing head, and introducing the one concentrate stream internally of the diluent flow into the cup, and mixing the one first liquid and diluent together in the cup and passing the mixture downstream of the cup in a combined stream.

32. The method as in claim 31, further including the step of introducing the diluent initially as a stream into a first portion of the second flow passage, and then directing the diluent stream through a gradual, outwardly-tapered passage to a constant-diameter passage, and then to the second outlet.

33. The method as in claim 31, further including the step of introducing the second liquid initially as a stream into a first portion of the second flow passage, and then directing the second liquid stream at least one radially-directed passage to a constant-diameter passage, and then to the second outlet.

34. A multi-flavor post-mix dispense head, comprising:

a nozzle having a plurality of first fluid inlets for first fluids and a second fluid inlet for a second fluid, a plurality of first outlets and a second fluid outlet, said second fluid outlet defining an annulus surrounding the first fluid outlets; a plurality of first flow passages in the nozzle separately interconnecting each of the first fluid inlets with a respective first fluid outlet, and a second flow passage in the nozzle, fluidly separate from all of the first passages, interconnecting the second fluid inlet and the second fluid outlet, said annular second having a configuration which forms a cylindrical outlet flow of second fluid surrounding a fluid flow from any of the first fluid outlets, with the cylindrical outlet flow combining under surface tension into a single stream downstream from the nozzle, the combining of the second fluid into a stream defining a freely-supported cup external to the nozzle, with the first fluids respectively being introduced through the first fluid outlets internally of the cup to be mixed together with the second fluid, and passed downstream from the nozzle in a combined stream, wherein said first liquid outlet port includes a spray device which directs the first liquid in a spray outwardly into the cup formed by the second liquid.

* * * * *